US007066104B1

(12) United States Patent
Beal et al.

(10) Patent No.: US 7,066,104 B1
(45) Date of Patent: Jun. 27, 2006

(54) MARINE VESSEL STRUCTURAL INTERFACE

(76) Inventors: Robert W. Beal, 9600 SW Iowa Dr., Tualatin, OR (US) 97062; Thomas J Vincent, 1349 Westview Dr., Grants Pass, OR (US) 97527; Ronald W Bosch, 20387 Nathan La., Fairview, OR (US) 97062

( * ) Notice: Subject to any disclaimer, the term of this patent is extended or adjusted under 35 U.S.C. 154(b) by 0 days.

(21) Appl. No.: 10/861,552

(22) Filed: Jun. 4, 2004

(51) Int. Cl.
*B63B 7/04* (2006.01)

(52) U.S. Cl. ..... 114/352; 114/77 R

(58) Field of Classification Search ..... 114/352, 114/77 R, 77 A, 117
See application file for complete search history.

(56) References Cited

U.S. PATENT DOCUMENTS 2,569,611 A * 10/1951 Jenkins ..... 114/352
5,606,929 A * 3/1997 Huang ..... 114/77 R

* cited by examiner

*Primary Examiner*—Jesus D. Sotelo
(74) *Attorney, Agent, or Firm*—Ingrid McTaggart

(57) ABSTRACT

One embodiment of a structural interface for a marine vessel includes a first plate having a recess for receiving an alignment projection therein and a first block manufactured of a first, sacrificial material, and a second plate having an outwardly extending alignment projection adapted to be received within said recess and a second block manufactured of a second, non-sacrificial material and positioned to mate with said first block.

31 Claims, 4 Drawing Sheets

MARINE VESSEL STRUCTURAL INTERFACE

BACKGROUND

Marine vessel hulls may include a cargo area for receiving a variety of sized cargo therein. An open cargo area may be exposed on an exterior surface of the marine vessel such that the vessel may not be water tight and may be susceptible to radar detection. A closed cargo area may not allow a variety of cargo to be carried by the vessel.

DETAILED DESCRIPTION OF THE DRAWINGS

Figure 1:
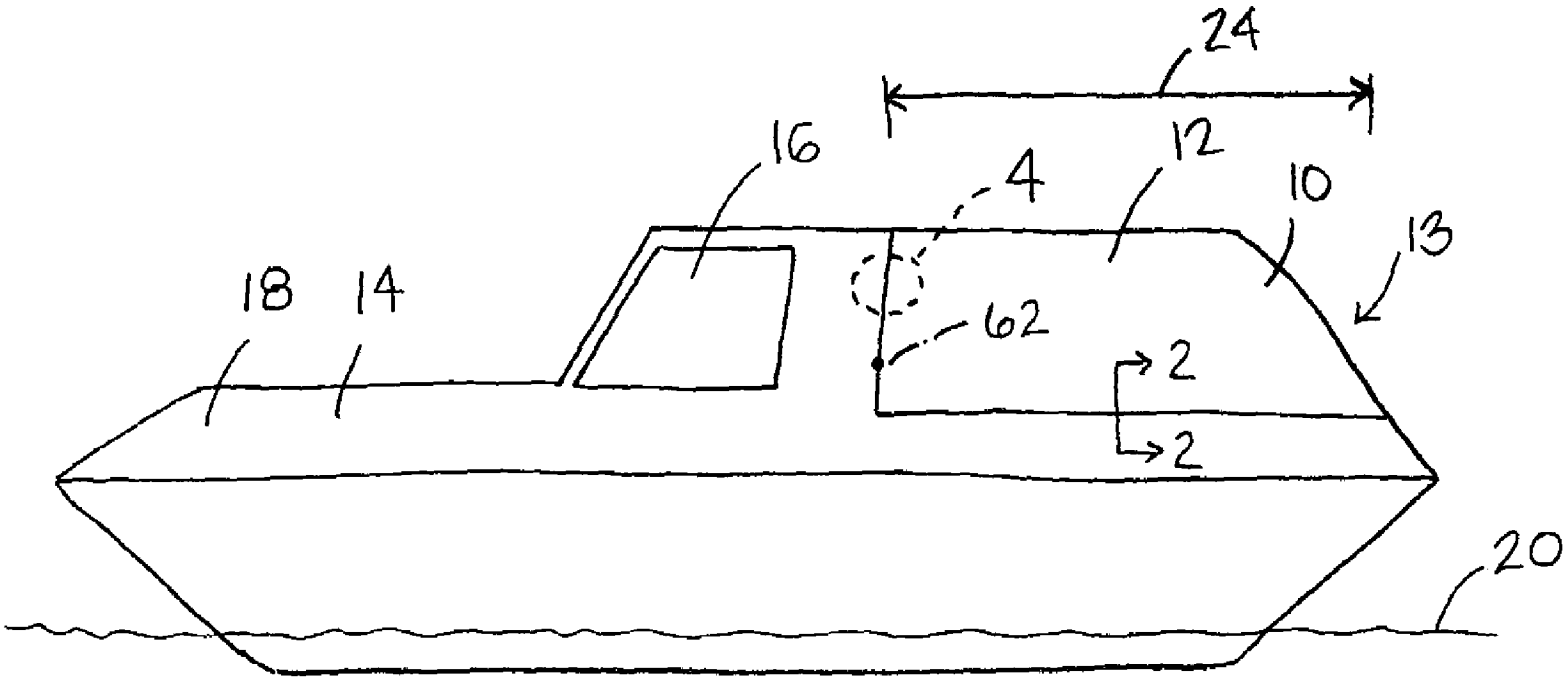
FIG. 1 is a side view of one embodiment of a marine vessel including one embodiment of a module secured by one embodiment of a structural interface.

FIG. 1 is a side view of one embodiment of a marine vessel 10 including one embodiment of a module 12 for holding cargo within an interior 13 thereof. Vessel 10 may comprise any vessel adapted for use on or in water, such as a boat, a submarine, or a plane adapted for landing on water. In the embodiment shown, vessel 10 may comprise a boat including a hull 14, wherein hull 14 may comprise a portion of vessel 10 that may come into contact with a body of water through which vessel 10 moves. Different modules 12 may hold a variety of cargo therein such that vessel 10 may have any standardized module 12 secured thereto so as to transport a variety of cargo and so as to accomplish a variety of missions without requiring remanufacturing of hull 14. Vessel 10 may further include a control area 16 for crew members or control components. Hull 14 may include an exterior surface 18 that may generally be streamlined and/or have a smooth surface so as to cut through the water and/or air during movement of vessel 10 therethrough and so as to reduce detection of vessel 10 by radar systems. Module 12 may be positioned anywhere within hull 14 but generally may be positioned in a region of hull 14 that may come into contact with water 20 surrounding hull 14. Accordingly, it may be desirable that module 12 and hull 14 are secured together by a structural interface that defines a water-tight seal between module 12 and hull 14.

Figure 2:
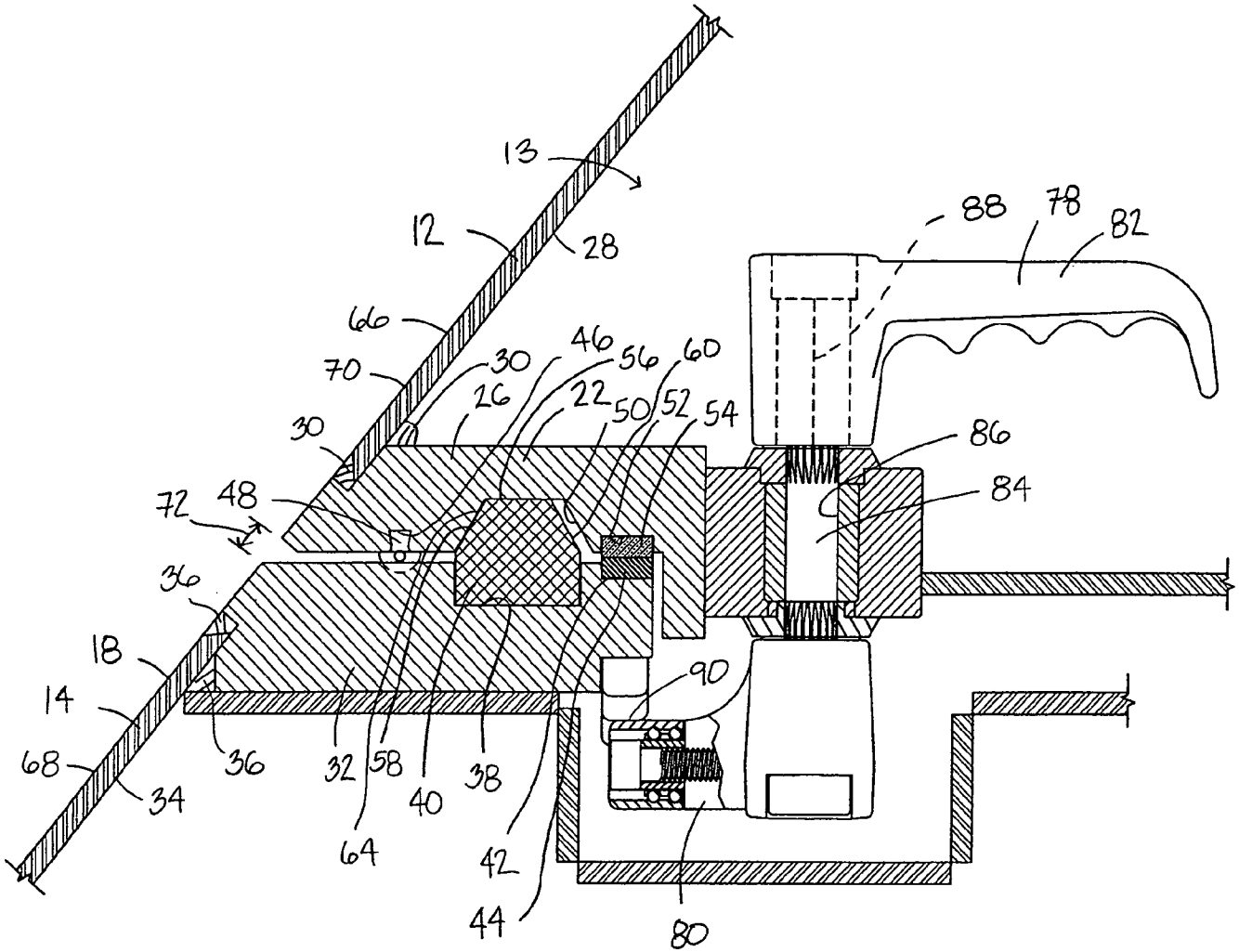
FIG. 2 is a cross sectional view taken along lines 2—2 of FIG. 1 showing one embodiment of a structural interface for securing a module to a vessel hull, wherein the structural interface may extend along a length of the module.

FIG. 2 is a cross sectional view taken along lines 2—2 of FIG. 1 showing one embodiment of a structural interface 22 for securing module 12 to vessel hull 14, wherein structural interface 22 may extend along a length 24 (see FIG. 1) of module 12. Structural interface 22 may include a first plate 26 secured to an interior surface 28 of module 12, such as by a weld, or welds, 30. Structural interface 22 may also include a second plate 32 secured to an interior surface 34 of hull 14, such as by a weld, or welds, 36. First and second plates 26 and 32 may be machined from a rugged material such as aluminum or steel so that the plates may provide structural integrity and strength to vessel 10 and to the interface between hull 14 and module 12. Second plate 32 may include a recess 38 for receiving an alignment block 40 therein, and a recess 42 for receiving a slide block 44 therein. First plate 26 may include a recess 46 for receiving a seal 48 therein, a recess 50 for receiving alignment block 40 therein, and a recess 52 for receiving a slide block 54 therein. Of course, the position of the recesses and components of structural interface 22 may be positioned on either of first or second pates 26 and 32.

Alignment block 40 may include a top surface 56 and tapered side surfaces 58 and 60 that may facilitate alignment of block 40 within mating recess 50 of first plate 26. In one embodiment, module 12 may have a width 62 (shown in end view in FIG. 1) such that a tapered surface 64 of recess 50 may be positioned abutting against tapered side surface 58 of block 40, (and so that a tapered surface of the module may abut an alignment block of the hull on an opposite side of module 12), so as to align exterior surface 18 of hull 14 with exterior surface 66 of module 12. Accordingly, alignment block 40 of second plate 32 and mating recess 50 of first plate 26 may facilitate positioning of exterior surface 18 of hull 14 in a plane 68 and exterior surface 66 of module 12 in a plane 70, wherein plane 68 and plane 70 are substantially the same plane, i.e., the planes are positioned within 0.1 inch or less from one another, wherein the 0.1 inch measurement is measured perpendicular to planes 68 and 70. Accordingly, structural interface 22 may position module 12 on hull 14 such that there are no substantial steps, i.e., no vertical discontinuities of more than 0.1 inch (measured perpendicular to planes 68 and 70), on an exterior of hull 14 such that vessel 10 may be substantially undetectable by radar systems.

Similarly, alignment block 40 of second plate 32 and mating recess 50 of first plate 26 may facilitate positioning of module 12 on hull 14 so as to define a gap 72 between module 12 and hull 14, wherein gap 72 may have a width of 0.1 inch or less, wherein the 0.1 inch measurement is measured parallel to planes 68 and 70. Accordingly, structural interface 22 may position module 12 on hull 14 such that there are no substantial gaps, i.e., no horizontal discontinuities of more than 0.1 inch (measured parallel to planes 68 and 70), on an exterior of hull 14, such that vessel 10 may be substantially undetectable by radar systems. Other shapes of alignment block 40 and mating recess 50 may be utilized, such as mating triangular surfaces, mating curved surfaces or mating irregular surfaces, for example, so as to provide an alignment contact between module 12 and hull 14 at structural interface 22.

Still referring to FIG. 2, seal 48 may be manufactured of a water tight material, such as an elastomeric material, for example, rubber or plastic, so as to create a water tight seal between plate 26 and plate 32 when module 12 is secured to hull 14. First and second plates 26 and 32, and seal 48 positioned therebetween, may extend completely around a perimeter of module 12 such that seal 48 may defines a water tight seal substantially therearound.

Alignment block 40 may be manufactured of a rugged but somewhat deformable material, such as ultra high molecular weight polyethylene, so that block 40 may act as an alignment device but may not be required to fully support a weight of module 12 when secured on hull 14. Other materials may be utilized for the manufacture of block 40.

Slide blocks 44 and 54 may contact one another when module 12 is secured on hull 14 by structural interface 22. Accordingly, blocks 44 and 54 may carry the structural load or weight of module 12 and may be susceptible to friction if module 12 moves relative to hull 14 while module 12 is secured thereon. Accordingly, one of slide blocks 44 and 54 may be manufactured of bronze and the other of slide blocks 44 and 54 may be manufactured of stainless steel, such that the bronze slide block may act as a sacrificial surface. In other words, the contacting surface of the sacrificial slide block may yield, i.e., may deform or wear, prior to yielding of the stainless steel slide block, if friction develops between blocks 44 and 54. Due to the presence of blocks 44 and 54, therefore, there may be an absence of frictional, aluminum-to-aluminum contact within vessel 10, which might act to degrade or otherwise deform vessel 10.

Hull 14, module 12, first and second plates 26 and 32, and welds 30 and 36 may be manufactured of an electrically conductive material, such as aluminum. Blocks 44 and 54 may be manufactured of an electrically conductive material and may be secured to first plate 26 and second plate 32, respectively, so as to define a substantially continuous electrical conductivity path between hull 14 and module 12, through first and second plates 26 and 32 and through blocks 44 and 54. Accordingly, due to the substantially continuous electrical conductivity path through hull 14 and module 12, vessel 10 may be substantially undetectable by radar systems. Blocks 44 and 54 may extend completely along a length 24 (see FIG. 1) and a width 62 (see FIG. 1) of module 12, or may have a relatively short length, such as several inches, and may be placed intermittently along length 24 and width 62 as may be desired for a particular application.

Still referring to FIG. 2, first plate 26 may further include a securing device 78, which may include an arm 80 secured to a handle 82 by a shaft 84. Shaft 84 may extend through a recess 86 in first plate 26 such that rotation of handle 84 about an axis 88 may cause corresponding rotation of arm 80 about axis 88. Accordingly, in the embodiment shown, handle 82 may be manually rotated about axis 88 to position arm 80 in contact with a latch surface 90 of second plate 32 so as to retain module 12 on hull 14. In other embodiments, arm 80 may be rotated into a securing position on latch surface 90 by a motor or other automatic means. In still other embodiments, the rotating components of securing device 78 may be positioned on second plate 32.

Figure 3:
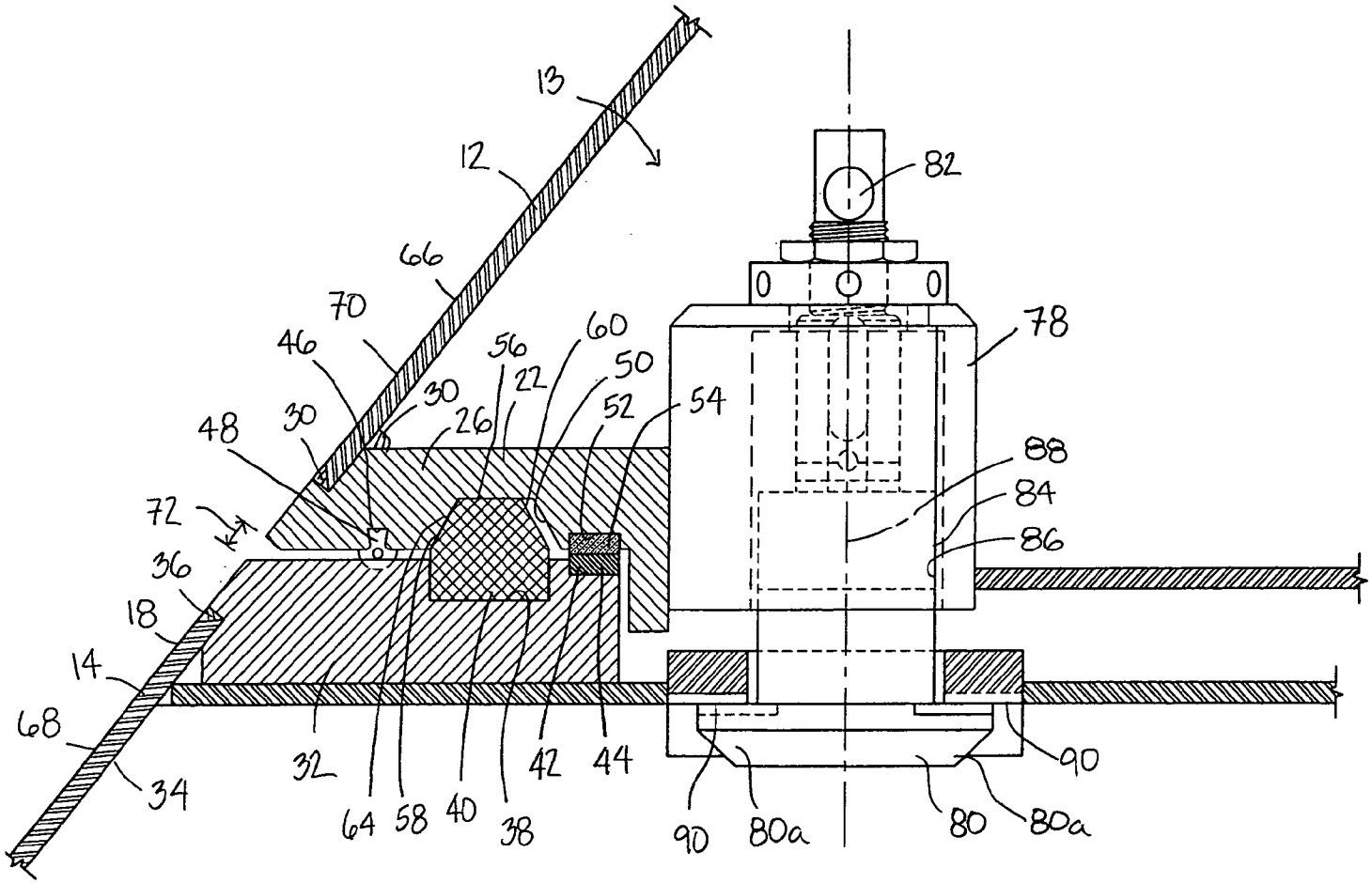
FIG. 3 is a cross sectional view showing another embodiment of a structural interface for securing a module to a vessel hull, wherein the structural interface may extend along a length of the module.

FIG. 3 is a cross sectional view showing another embodiment of a structural interface 22 for securing module 12 to vessel hull 14. In this embodiment, securing device 78 may comprise an arm 80 secured to a handle 82 (shown extending out of the page and toward the viewer) by a shaft 84. Shaft 84 may extend through a recess 86 in first plate 26 such that rotation of handle 84 about an axis 88 may cause corresponding rotation of arm 80 about axis 88. In the embodiment shown, handle 82 may be manually rotated about axis 88 to position outwardly extending projections 80*a* of arm 80 in contact with latch surfaces 90 of second plate 32 so as to retain module 12 on hull 14. To release module 12 from hull 14, handle 82 may be rotated 90 degrees about axis 80 from the position shown, such that outwardly extending projections 80*a* of arm 80 may be positioned extending into and out of the page toward the viewer such that projections 80*a* may be positioned to move through recess 86 of first plate 26. In other embodiments, arm 80 may be rotated into a securing position on latch surface 90 by a motor or other automatic means, and the rotating components of securing device 78 may be positioned on second plate 32.

Figure 4:
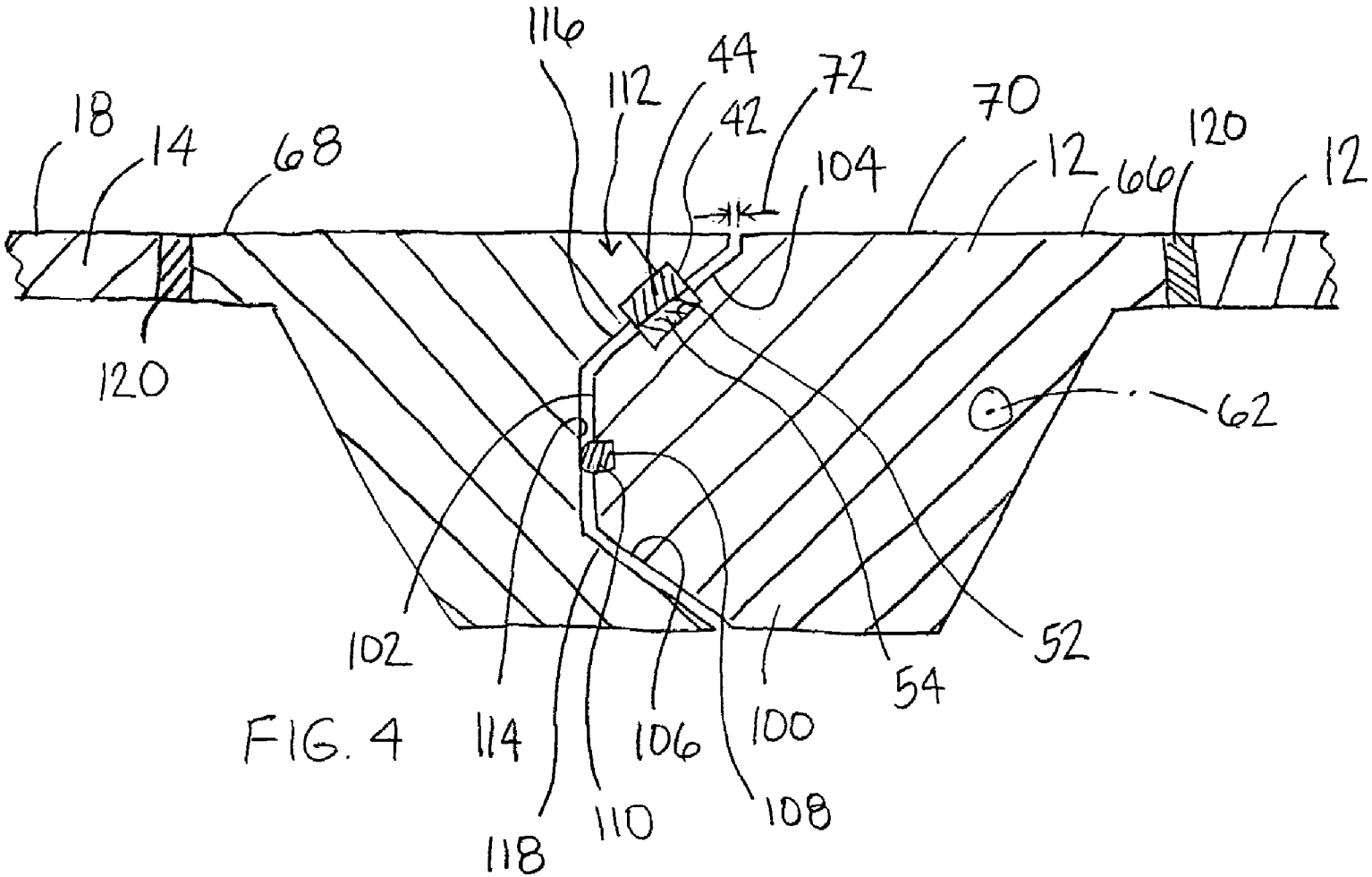
FIG. 4 is a cross sectional view of one embodiment of a structural interface for securing a module to a vessel hull, wherein the structural interface may extend transversely, along a width of the module.

FIG. 4 is a cross sectional view of one embodiment of another component of structural interface 22 for securing module 12 to vessel hull 14, viewed in the direction of width 62 (see FIG. 1) of module 12. In this component of structural interface 22, module 12 may include an outwardly extending projection 100 having an outermost, or top, surface 102 and two tapered side surfaces 104 and 106, such that projection 100 has a generally truncated triangle shape that is received within a recess 112, described below. Outermost surface 102 may include a recess 108 having a seal 110 secured therein. Hull 14 may include a mating recess 112 including an innermost surface 114 and two tapered side surfaces 116 and 118 that matingly receive tapered side surfaces 104 and 106 of projection 100 of module 12. When module 12 is secured to hull 14, as shown in FIGS. 2 and 3, projection 100 may be positioned within recess 112 such that seal 110 defines a water tight seal between module 12 and hull 14 along width 62 (shown extending into the page). Moreover, positioning of projection 100 within recess 112 may define a structural connection such that module 12 may be secured against movement relative to hull 14 by the capture of projection 100 within recess 112.

In the embodiment shown, projection 100 may include a recess 52 have a slide block 54 positioned therein, and recess 112 may include a recess 42 having a slide block 44 positioned therein. One of blocks 44 and 54 may be manufactured of a sacrificial material, such as bronze, such that there may be no frictional aluminum-to-aluminum contact at the contact point between projection 100 and recess 112. The contact between blocks 44 and 54, moreover, may provide a substantially continuous electrical conductivity contact so that vessel 10 may be substantially undetectable by radar systems. In another embodiment, wherein slide blocks 44 and 54 may not be present, surface 104 of projection 100 may be in contact with surface 116 of hull 14. In other embodiments, the structural interface 22 (see FIGS. 2 and 3) that extends along length 24 (see FIG. 1) of module 12 may position projection 100 within recess 112 along width 62 of module 12, but not in contact with the recess, such that only seal 110 of projection 100 may be in contact with a surface of recess 112.

Projection 100 may be a machined component that may be secured to a remainder of module 12 by a weld 120. Machining of projection 100 may reduce the occurrence of stresses within projection 100 that may be created by other manufacturing techniques such as when the component is created from a mold. Similarly, recess 112 may be positioned on a machined component that may be welded to hull 14 by a weld 120. Projection 100 and mating recess 112 may position exterior surface 66 of module 12 and exterior surface 18 of hull 14 in substantially the same plane 68 and 70, respectively, such that there are no substantial steps on vessel 10, i.e., such that planes 68 and 70 are positioned within 0.1 inch or less of one another, and such that vessel 10 may be substantially undetectable by radar systems. By "substantially the same plane" applicants mean that the structural components recited each define a plane within 0.1 inch, or less, of one another, wherein the 0.1 inch measurement is measured perpendicular to planes 68 and 70. In other words, there may be a vertical step of 0.1 inch or less between the two planes. Moreover, projection 100 and mating recess 112 may position module 12 and hull 14 adjacent one another such that there may be a gap 72 therebetween, wherein gap 72 may be 0.1 inch or less, such that there are no substantial gaps on vessel 10. Accordingly, there may be no appreciably visible gap between module 12 and hull 14 and vessel 10 may be substantially undetectable by radar systems. Furthermore, weld 120 may define an outer surface positioned within plane 70. Accordingly, hull 14, weld 120, and module 12 may define a substantially smooth, continuous exterior surface of marine vessel 10 having no substantial steps (vertical discontinuities) and no substantial gaps (horizontal discontinuities) such that marine vessel 10 may be substantially undetectable by radar systems.

Accordingly, there is provided a structural interface 22 that may provide one or more of the following structural aspects: a water tight seal between a module and a marine vessel hull; mating alignment surfaces on the module and the hull so as to align the module on the hull; a friction reducing or sacrificial surface that may also provide an electrical conductivity path between the module and the hull; and a securement device for securing the module on the hull.

Other variations and modifications of the concepts described herein may be utilized and fall within the scope of the claims below.

We claim:

1. A structural interface for a marine vessel, comprising:

a first plate that includes a recess for receiving an alignment projection therein and a first block manufactured of a first, sacrificial material; and a second plate that includes an outwardly extending alignment projection adapted to be received within said recess and a second block manufactured of a second, non-sacrificial material and positioned to mate with said first block.

2. An interface according to claim 1 further including a seal secured to one of said first plate and said second plate, said seal defining a water tight seal between said first and second plates when said plates are secured to one another.

3. An interface according to claim 1 further including a securement device secured to one of said first plate and said second plate, said securement device adapted for securely engaging another of said first plate and said second plate in a secured position.

4. An interface according to claim 1 wherein one of said first plate and said second plate is positioned on a module, and wherein another of said first plate and said second plate is positioned on a marine vessel hull.

5. An interface according to claim 4 wherein said module includes a exterior surface and wherein said hull includes an exterior surface, and wherein said structural interface positions said module exterior surface substantially in a same plane as said hull exterior surface.

6. An interface according to claim 4 wherein one of said first plate and said second plate is positioned on an interior surface of said module, and wherein another of said first plate and said second plate is positioned on an interior surface of said marine vessel hull.

7. An interface according to claim 1 wherein said sacrificial material is bronze and wherein said non-sacrificial material is stainless steel.

8. An interface according to claim 1 wherein said first and second plates are manufactured of aluminum and wherein said fist and second blocks provide an electrical conductivity path between said first and second plates.

9. An interface according to claim 1 wherein said projection comprises an alignment block secured to said second plate and being manufactured of ultra high molecular weight polyethylene.

10. An interface according to claim 1 wherein said projection has a cross-sectional shape of a truncated triangle and wherein said recess has a mating cross-sectional shape of a truncated triangle.

11. An interface according to claim 1 wherein said first plate defines a length and wherein said recess extends substantially along said length of said first plate, and wherein said second plate defines a length and wherein said projection extends substantially along said length of said second plate.

12. A marine vessel, comprising:

a non-collapsible hull including an interior surface;

a module separate from said non-collapsible hull and including an interior surface;

an alignment projection secured to one of said interior surface of said hull and said interior surface of said module;

a recess positioned in another of said interior surface of said hull and said interior surface of said module, said recess positioned to receive said alignment projection when said module is positioned on said hull; and a seal secured to one of said interior surface of said hull and said interior surface of said module, said seal positioned to contact another of said interior surface of said hull and said interior surface of said module when said module is positioned on said hull.

13. A marine vessel according to claim 12 further comprising:

a first block secured to one of said interior surface of said hull and said interior surface of said module, said first block manufactured of a sacrificial material;

a second block secured to another of said interior surface of said hull and said interior surface of said module, said second block manufactured of a non-sacrificial material and positioned to contact said first block when said module is positioned on said hull.

14. A marine vessel according to claim 13 wherein said first and second blocks provide weight bearing support of said module on said hull.

15. A marine vessel according to claim 13 wherein said hull and said module are both manufactured of an electrically conductive material, and wherein said first and second blocks provide a continuous electrical conductivity path between said hull and said module when said module is secured on said hull.

16. A marine vessel according to claim 13 wherein said hull and said module are both manufactured of aluminum, said first block is manufactured of bronze and said second block is manufactured of stainless steel.

17. A marine vessel according to claim 12 further comprising:

a securement device secured to one of said interior surface of said hull and said interior surface of said module; and a securement surface positioned on one of said interior surface of said hull and said interior surface of said module and adapted for receiving said securement device thereon so as to secure said module to said hull.

18. A marine vessel according to claim 12 further comprising:

an alignment block secured to one of said interior surface of said hull and said interior surface of said module, wherein said alignment block includes said alignment projection, and wherein said alignment block is manufactured of ultra high molecular weight polyethylene.

19. A marine vessel according to claim 12 wherein said alignment projection defines a convex cross-sectional shape and wherein said recess defines a mating concave cross-sectional shape for receiving said projection therein.

20. A marine vessel according to claim 12 wherein said projection and said recess mate to position said module on said hull such that an exterior surface of said hull is positioned in substantially the same plane as an exterior surface of said module.

21. A marine vessel according to claim 12 wherein said interior surface of said hull is positioned on a first plate welded to said hull and wherein said interior surface of said module is positioned on a second plate welded to said module.

22. A marine vessel according to claim 12 wherein said module defines a cavity sized to receive a variety of cargos therein.

23. A method of removably securing a cover to a buoyant marine vessel hull, comprising:

positioning an alignment projection within an alignment recess so as to align said cover on said hull in a predetermined position;

positioning a load bearing surface of said cover on a load bearing surface of said hull; and moving a securement device to a secured position to secure said cover on said hull.

24. A method according to claim 23 further comprising:

positioning a seal on a seal receiving surface so as to define a water tight seal between said module cover and said hull.

25. A method according to claim 23 wherein said positioning said alignment projection positions an exterior surface of said cover in substantially the same plane as an exterior surface of said hull.

26. A method according to claim 23 wherein said positioning a load bearing surface of said cover on a load bearing surface of said hull provides an electrical conductivity path between said cover and said hull.

27. A method according to claim 23 wherein said moving a securement device to a secured position comprises rotating a handle so as to rotate an outwardly extending projection of said securement device into contact with a latch surface.

28. A marine vessel structural interconnect, comprising:

means for aligning a module on a complete marine vessel hull separate from said module;

means for creating a water tight seal between said module and said hull; and means for reducing frictional contact between said module and said hull.

29. A marine vessel according to claim 28 wherein said means for aligning comprises a projection including an outermost surface and a surface inclined with respect to said outermost surface, and a recess including an innermost surface and a surface inclined with respect to said innermost surface.

30. A marine vessel according to claim 28 wherein said means for reducing frictional contact comprises a sacrificial surface and a non-sacrificial surface that contact one another.

31. A marine vessel, comprising:

a hull having a water tight water-contacting surface;

a cover removably positioned on said hull;

an alignment projection secured to one of said hull and said cover;

a recess positioned in the other of said hull and said cover, said recess positioned to receive said alignment projection when said cover is removably positioned on said hull; and a seal secured to one of said hull and said cover, said seal positioned to contact the other of said hull and said cover when said cover is removably positioned on said hull.

* * * * *